US008813308B2

(12) United States Patent
Xue

(10) Patent No.: US 8,813,308 B2
(45) Date of Patent: Aug. 26, 2014

(54) UPRIGHT VACUUM CLEANER

(75) Inventor: Jian Xue, Suzhou (CN)

(73) Assignee: Hoover, Limited, Merthyr Tydfil (GB)

( * ) Notice: Subject to any disclaimer, the term of this patent is extended or adjusted under 35 U.S.C. 154(b) by 25 days.

(21) Appl. No.: 13/293,055

(22) Filed: Nov. 9, 2011

(65) Prior Publication Data

US 2012/0124768 A1 May 24, 2012

(30) Foreign Application Priority Data

Nov. 15, 2010 (GB) ..... 1019218.5

(51) Int. Cl.
*A47L 5/00* (2006.01)

(52) U.S. Cl.
USPC ..... 15/411; 15/351; 15/410

(58) Field of Classification Search
USPC ..... 15/410, 411, 350, 327.1–327.7, 351
See application file for complete search history.

(56) References Cited

U.S. PATENT DOCUMENTS

| | | | | | |
|---|---|---|---|---|---|
| 2,530,886 | A * | 11/1950 | Maisel | 280/47.11 |
| 5,794,305 | A * | 8/1998 | Weger | 15/411 |
| 6,058,559 | A * | 5/2000 | Yoshimi et al. | 15/328 |
| 2001/0037536 | A1* | 11/2001 | Kim | 15/361 |
| 2003/0145422 | A1 | 8/2003 | Kaffenberger | |
| 2008/0263814 | A1* | 10/2008 | Bassett et al. | 15/345 |
| 2009/0056058 | A1 | 3/2009 | Finke | |
| 2009/0056065 | A1* | 3/2009 | Finke | 15/354 |
| 2009/0165242 | A1* | 7/2009 | Lee et al. | 15/411 |
| 2011/0107553 | A1* | 5/2011 | Myers | 15/411 |

FOREIGN PATENT DOCUMENTS

| | | | | |
|---|---|---|---|---|
| DE | 29619645 U | | 11/1996 | |
| DE | 29619645 U1 | * | 1/1997 | A47L 9/02 |
| EP | 0708613 A1 | | 5/1996 | |
| EP | 1647219 A2 | | 4/2006 | |
| EP | 2030550 A2 | | 8/2008 | |
| EP | 1985218 A1 | | 10/2008 | |
| GB | 2403135 A | | 12/2004 | |
| GB | 2433425 | | 6/2007 | |
| GB | 2448745 | | 10/2008 | |
| JP | 64-32828 | * | 2/1989 | A47L 5/28 |
| JP | S-64032828 | | 2/1989 | |
| JP | 2006247077 A | | 9/2006 | |

* cited by examiner

*Primary Examiner* — Mark Spisich
*Assistant Examiner* — Andrew A Horton
(74) *Attorney, Agent, or Firm* — Muskin & Farmer LLC

(57) ABSTRACT

A vacuum cleaner having an elongate body portion 11 which is mounted at its lower end via a neck 15 to the rear of a wheeled floor-engaging head portion 10, the body 11 being pivotable in use relative to the head about a first axis A1 for movement upwardly and downwardly and about a second orthogonal axis A2 for movement from side-to-side. A catch 17 is disposed on the neck 15 for preventing pivotal movement of the body 11 about the second axis A2 when the body 11 is disposed in its most upright position. The provision of the catch 17 improves the stability of the cleaner when the cleaner is not in use or when it is being used for above floor cleaning.

13 Claims, 4 Drawing Sheets

UPRIGHT VACUUM CLEANER

CROSS REFERENCE TO RELATED APPLICATIONS

This Application claims benefit under 35 U.S.C. 119 to Great Britain Application No. 1019218.5, filed in the Great Britain Patent Office on Nov. 15, 2010 by inventor Jian Xue, which is incorporated by reference herein in its entirety for all purposes.

BACKGROUND OF THE INVENTION

1. Field of the Invention

This invention relates to an upright vacuum cleaner and more particularly to an upright vacuum cleaner having a steerable head.

2. Related Background Art

Conventional upright vacuum cleaners generally comprise an elongate upright body portion which contains a dust separation device, such as a filter bag or cyclone, and an upstanding handle at its upper end. The lower end of the body is pivotally connected for forwards and rearwards movement to a wheeled floor-engaging head portion.

Upright vacuum cleaners are commonly provided with a lock, which locks the body and head together, in order to maintain the body in an upright position when not in use or when using any elongate flexible cleaning hose of the kind provided on many vacuum cleaners. Typically, the lock comprises a foot pedal, which must be depressed to release the lock, although some upright vacuum cleaners incorporate a lock which is released by applying an excessive rearwards force to the body.

A disadvantage of conventional upright vacuum cleaners is that they can sometimes be difficult to manoeuvre around obstacles such as furniture. In order to overcome this problem it has been proposed to provide an upright vacuum cleaner having a wheeled floor engaging head, which can be steered by twisting the handle on the body about its longitudinal axis. One such steerable vacuum cleaner is disclosed in EP7078613 and comprises an universal joint which couples the floor-engaging head portion to the body portion and which permits rotational movement in two orthogonal axes, so that the body portion can pivot about its longitudinal axis as well as forwardly and rearwardly. In this manner effective steering of the head can be accomplished by twisting the handle when the body is in its inclined position.

A disadvantage of such so-called steerable vacuum cleaners is that the ability of the body portion to effectively move sideways makes it difficult to lock the body portion in the upright position using a conventional locking mechanism.

In order to overcome this problem EP1985218 discloses a steerable vacuum cleaner vacuum cleaner having an elongate body which is pivotally mounted at its lower end to the rear of a wheeled floor-engaging head for movement about first and second orthogonal axes, which respectively extend generally transversely of the cleaner and generally longitudinally of the body, A catch is pivotally mounted intermediate its opposite ends to the upright body, the catch having a finger at its forward end arranged to engage a formation disposed adjacent a recess on the rear end of the head. The rearward end of the catch defines a foot pedal for moving the forward end of the catch out of engagement with the formation. When the body is moved to its upright position and into the recess, the catch on the body engages the head, to prevent the body from pivoting rearwards when the cleaner is not in use. The side walls of the recess also prevent the body from pivoting sideways.

We have now devised an improved vacuum cleaner of the kind disclosed in EP1985218.

SUMMARY OF THE INVENTION

In accordance with the present invention, there is provided a vacuum cleaner having an elongate body portion which is pivotally mounted at its lower end to the rear of a wheeled floor-engaging head portion for movement about first and second orthogonal axes, which respectively extend generally transversely of the cleaner and generally longitudinally of the body, the vacuum cleaner further comprising a locking device arranged to prevent pivotal movement of the body about said second axis when the body is disposed in a generally upright position.

We have realised that a disadvantage of the vacuum cleaner disclosed in EP1985218 is that the body is still able to pivot in the recess about the second axis when the body is disposed in the generally upright position, with the result that the catch may disengage the formation allowing the body to fall rearwardly. Also, the ability of the body to pivot about the second axis when in the generally upright position can lead to instability and can make it difficult to attach and detach parts to and from the body.

We have solved this problem by providing a locking device arranged to prevent pivotal movement of the body about the second axis when the body is disposed in the generally upright position. In this manner, the above-mentioned problems are avoided.

Preferably the locking device comprises a catch for preventing said movement about the second axis.

Preferably the locking device is also arranged to prevent pivotal movement of the body about said first axis when the body is disposed in said generally upright position.

Preferably the locking device comprises a further catch for preventing said movement about the first axis.

Preferably the catch for preventing said movement about the second axis is disposed on a neck portion of the cleaner which is pivoted to the head portion of the cleaner about said first axis.

Preferably the body portion of the cleaner pivots relative to the neck portion about said second axis.

Preferably the catch for preventing said movement about the second axis comprises a locking portion and an actuator portion, the actuator portion being arranged to abut the head of the cleaner when the body is pivoted into its generally upright position to cause interengagement of the body and neck portions of the cleaner and thereby prevent movement of the body about the second axis.

Preferably the actuator is biased into a position in which the body and neck portions are freely pivotable relative to each other when the body is pivoted away from its generally upright position.

Preferably the locking device is arranged to lock the body against pivotal movement in a predetermined rotational position about said second axis.

Preferably said predetermined rotational position comprises a position in which a front face of body portion faces in the same direction as a front face of the head portion of the cleaner.

Preferably the locking device is arranged to permit pivotal movement of the body about said second axis into said predetermined rotational position when the body is disposed in the generally upright position.

Preferably the locking portion of the catch engages in a circumferential groove disposed around the second axis when the body is pivoted into its generally upright position.

Preferably the circumferential groove is provided with a locking formation at a selected circumferential position, the locking portion engaging said formation when the body is at said predetermined rotational position.

Preferably the locking portion is arranged to snap engage with said formation upon rotation of the body about said second axis.

Preferably the body portion comprises a housing and a depending airflow duct, the duct being rotatably mounted to said neck portion of the cleaner for rotation of the body about said second axis.

Preferably the lower end of the duct is received in the neck, the circumferential groove extending around the lower end of the duct inside the neck.

BRIEF DESCRIPTION OF THE DRAWINGS

An embodiment of the present invention will now be described by a way of an example only and with reference to the accompanying drawings, in which.

DETAILED DESCRIPTION OF THE PREFERRED EMBODIMENT

Figure 1:
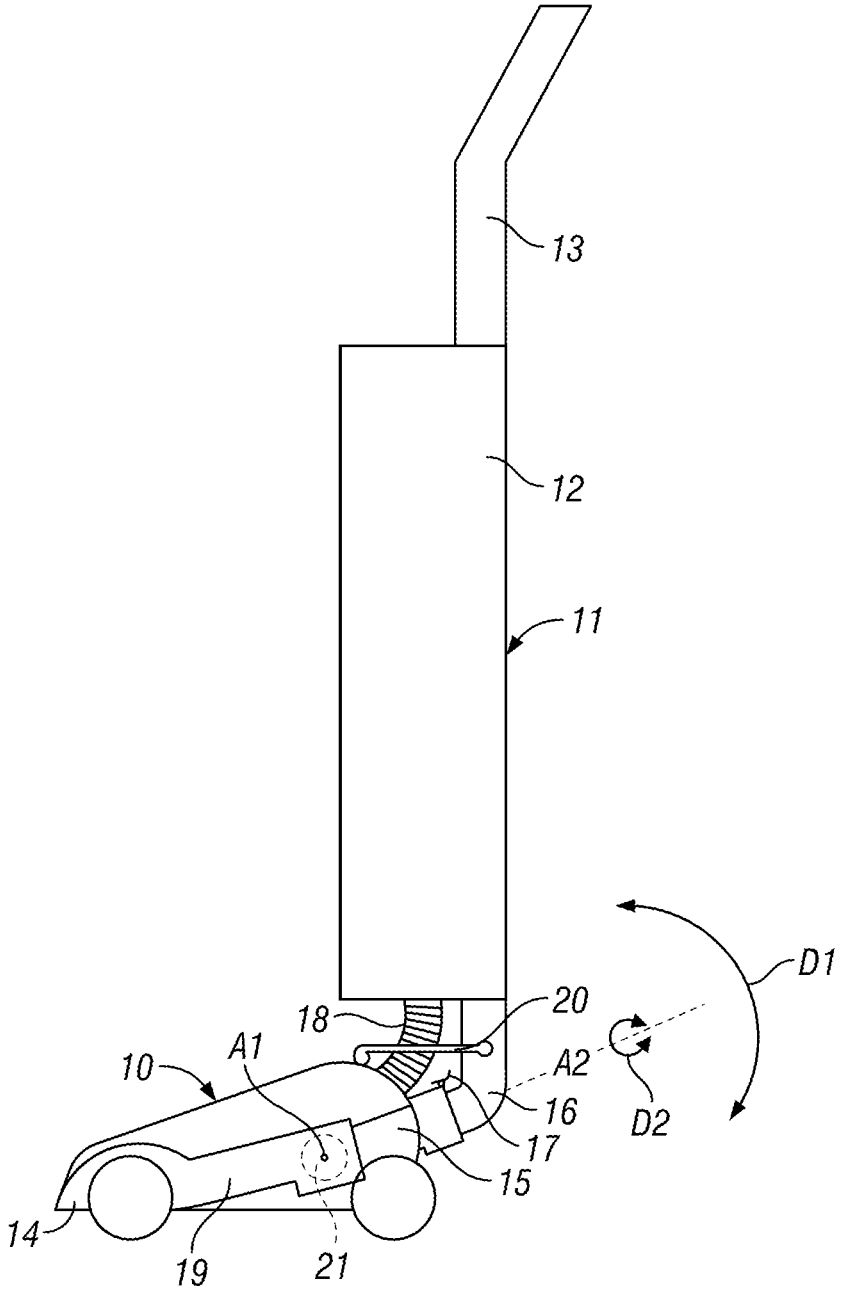
FIG. 1 is a schematic side view of an upright vacuum cleaner in accordance with the present invention.
Figure 2:
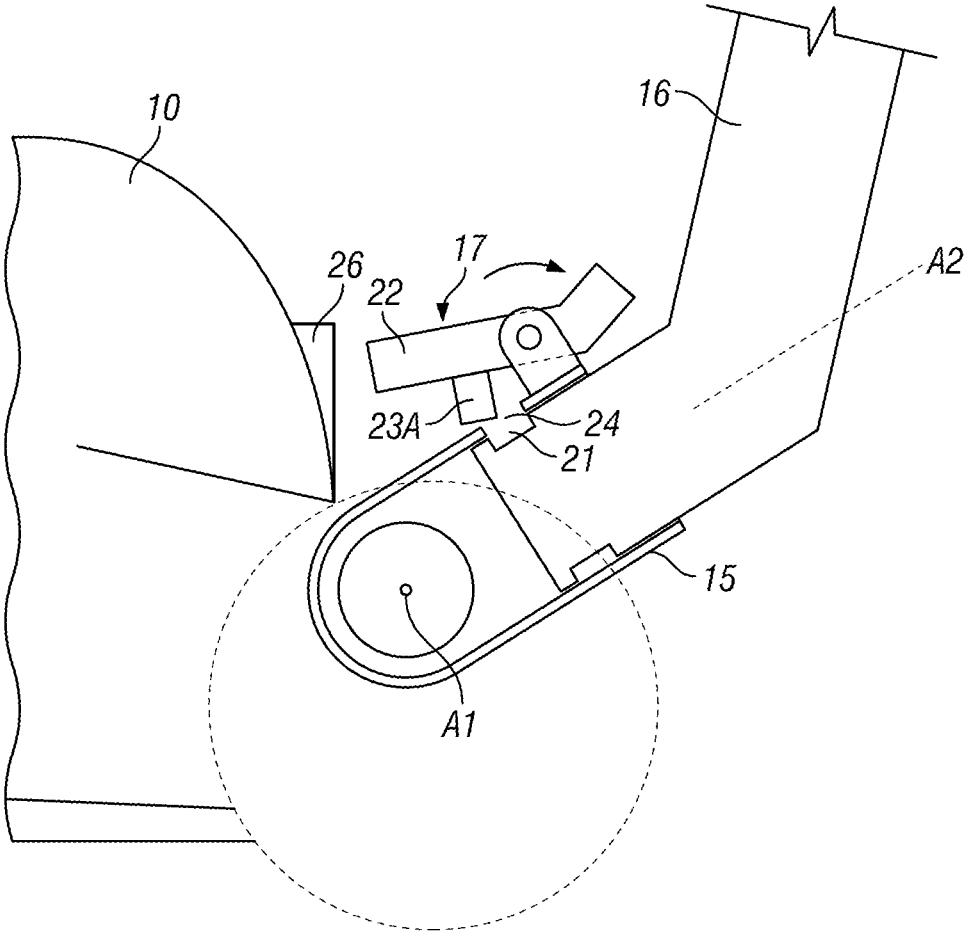
FIG. 2 is an enlarged view of the bottom rear portion of the cleaner of FIG. 1 when the body portion thereof is away from its upright position.
Figure 3:
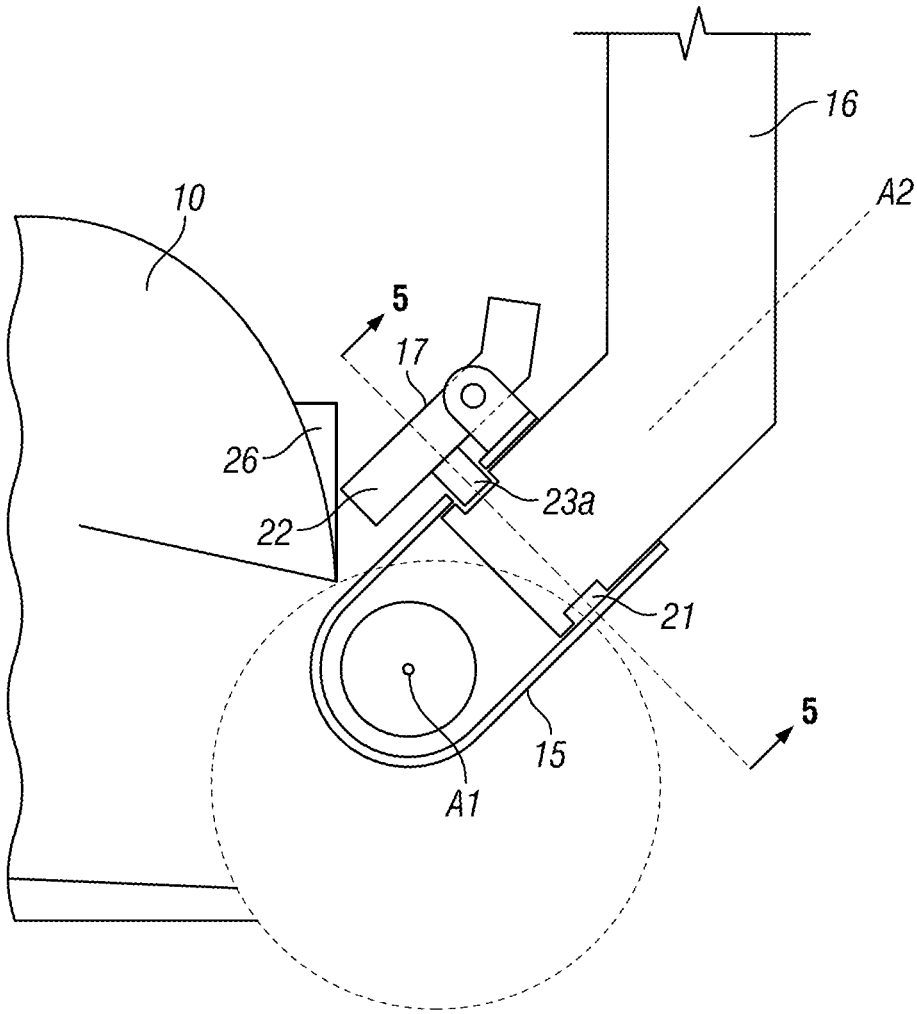
FIG. 3 is an enlarged view of the bottom rear portion of the cleaner of FIG. 1 when the body portion thereof is in its upright position.
Figure 4:
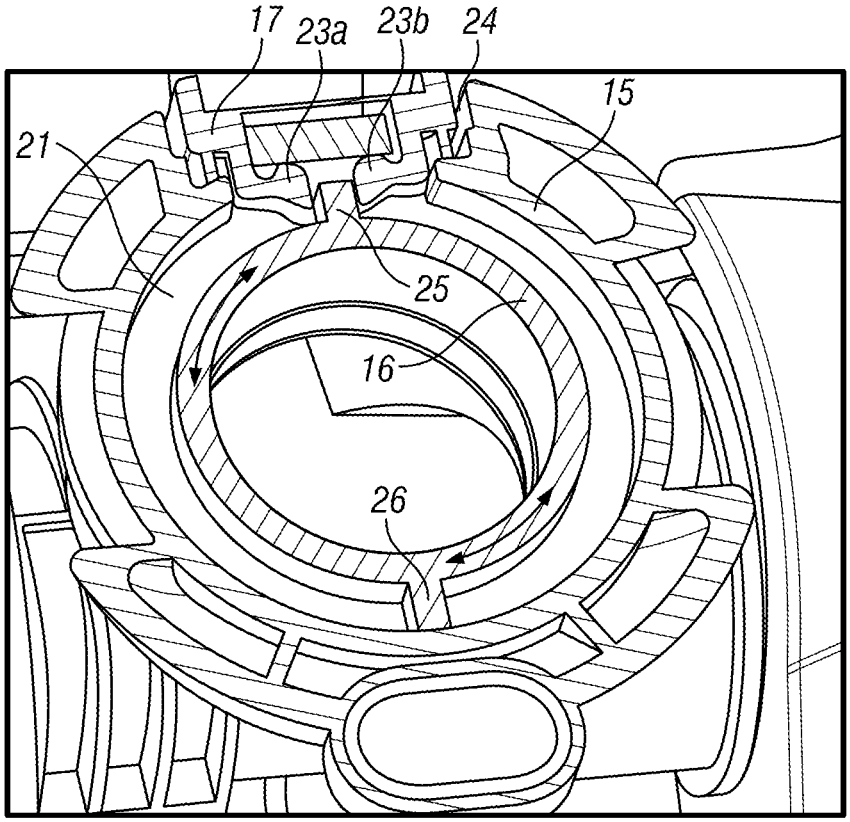
FIG. 4 is a sectional view along the line IV-IV of FIG. 3.

Referring to FIG. 1 of the drawings, there is shown a steerable upright vacuum cleaner comprising a wheeled floor-engaging head portion 10, which is pivotally connected at its rear to an upright elongate body portion 11. The body portion 11 comprises a housing 12 containing a dust separator (not shown), such as a filter bag or cyclone. An elongate handle 13 extends upwardly from the upper end of the housing 12 of the body portion 11.

The head portion 10 comprises an inlet 14 on its underside, through which dirty air is drawn into the vacuum cleaner by a motor-fan assembly (not shown). An agitator brush (not shown) is rotatably mounted across the inlet 14. An air inlet duct 19 extends rearwardly through the head 10 from the inlet 14, the rear end of duct 19 being turned through 90 degrees and is rotationally coupled to a tubular neck portion 15 of the cleaner to permit rotation of the neck 15 in direction D1 about an axis A1, which extends transverse the head 10.

The tubular neck 15 extends rearwardly from the centre of the rear end of the head 10, the distal end of the neck 15 embracing the lower end of a cranked tubular duct 16 which depends from the underside of the housing 12 of the body portion 11. The two tubes 15, 16 are coupled in such a manner as to allow the cranked duct 16 to rotate in direction D2 about the longitudinal axis A2 of its lower end.

The upper end of the duct 16 extends into the housing 12 of the body portion 11 and into the inlet of the dust separator (not shown). In the embodiment shown, the motor/fan unit (not shown) is disposed in the head portion 10 of the cleaner and is connected to the outlet of the dust separator by an elongate flexible duct 18, which extends between the head portion 10 and the body portion 11 of the cleaner.

It will be appreciated that the rotational coupling between the proximal end of the neck 15 and the duct 19 allows the body portion 11 of the vacuum cleaner to pivot forwardly and rearwardly in direction D1 about the axis A1. The rotational coupling between the neck 15 and the duct 16 allows the body portion 11 to pivot from side-to-side in direction D2 about the axis A2. In use, the head portion 10 of the cleaner can thus be steered by imparting a twisting movement to the handle 13. The neck 15 and the duct 16 also serve to support the body portion 11 of the cleaner on the head 10.

A catch 20 (shown schematically in FIG. 1) is pivotally mounted to the duct 16 for engaging a formation (not shown) on the rear of the head 10 of the cleaner. In use, the catch 20 serves to prevent rotation of the body portion about the axis A1 and to thereby hold the body portion 11 in its upright position for storage or when using an elongate flexible cleaning tube (not shown).

In accordance with the present invention, a further catch 17 is provided for preventing rotation of the body 11 relative to the head about the axis A2. The catch 17 comprises an arm 22, which extends longitudinally of the rearward end of the neck 15. The arm 22 is pivotally connected intermediate its opposite ends to the neck 15. The arm 22 carries a pair of resiliently-flexible fingers 23*a*, 23*b*, which are arranged over an aperture 24 in the neck 15, such that they can be extended into the groove 21 when the arm 22 is pivoted in the counter-clockwise direction as shown. A spring (not shown) acts against the rearward end of the arm 22 to bias the arm 22 in the clockwise direction as shown, so that the fingers 23*a*, 23*b* are normally positioned out of the groove 21.

A projection 25 extends radially from the tubular wall of the duct 16 into the groove 21, the projection 25 extending axially of the groove 21. The forward end of the arm 22 of the catch 17 is arranged to abut a formation 26 on the rear end of the head 10 when the body 11 is pivoted into its upright position about the axis A1: this forces the arm 22 to pivot in the counter-clockwise direction against the spring bias, such that the fingers 23*a*, 23*b* thereon enter the groove 21.

The fingers 23*a*, 23*b* lie tangentially of each other inside the groove 21, the fingers 23*a*, 23*b* comprising inclined outer surfaces which are directed in respective opposite directions circumferentially of the groove 21. The projection 25 in the groove 21 is disposed at a circumferential position, where it engages between the fingers 23*a*, 23*b* when the body is rotated about axis A2 into a position in which the front of the body 11 faces directly forwardly of the head 10. In this manner, rotation of the body 11 away from the forward-facing orientation is prevented when the body 11 is in its upright position.

In the event that the body 11 is pivoted into its upright position when the body 11 is rotated away from a forward-facing orientation, it will be appreciated that the projection 25 will be positioned radially away from the gap between the fingers 23*a*, 23*b*. However, the projection 25 can be brought into engagement between the fingers 23*a*, 23*b* by rotating the body 11 in either direction to cause the projection 25 to abut the inclined surface of one of the fingers e.g. 23*a*. Continued rotation of the body 11 causes the relevant finger eg 23*a* to flex until the projection 25 snap engages between the fingers 23*a*, 23*b* as shown.

A second projection 26 may be provided in the groove 21 to prevent the body 11 from being fully rotated about the axis A2.

The catch 17 is simple and inexpensive in construction and is able to effectively hold the body 11 of the cleaner in a forwards-facing orientation when the body is in its upright position. The provision of the catch 17 improves the stability of the cleaner when the cleaner is not in use or when it is being used for above floor cleaning.

While the preferred embodiment of the invention has been shown and described, it will be understood by those skilled in the art that changes of modifications may be made thereto without departing from the true spirit and scope of the invention.

What is claimed is:

1. A vacuum cleaner comprising:

an elongate body portion having a housing and a depending tubular duct;

a wheeled floor-engaging head portion;

a tubular neck portion at the rear of the head portion, the neck being pivoted to the head about a first axis, the duct being rotatably connected to the neck about a second orthogonal axis to define an airflow passage extending between the body and head, the body being moveable upwardly and downwardly about said first axis and from side-to-side about said second axis, the vacuum cleaner further comprising a locking device arranged to lock the duct to the neck to prevent pivotal movement of the body about said second axis when the body is disposed in its most upright position; and a catch for preventing said movement about the second axis, wherein the catch comprises a locking portion and an actuator portion, the actuator portion being arranged to abut the head of the cleaner when the body is pivoted into its most upright position to cause interengagement of the body and neck portions of the cleaner and thereby prevent movement of the body about the second axis.

2. A vacuum cleaner as claimed in claim 1, in which the catch is disposed on a neck portion.

3. A vacuum cleaner as claimed in claim 1, in which the actuator is biased into a position in which the body and neck portions are freely pivotable relative to each other when the body is pivoted away from its most upright position.

4. A vacuum cleaner as claimed in claim 3, in which in which the catch is disposed on a neck portion of the cleaner.

5. A vacuum cleaner as claimed in claim 1, in which the locking device is arranged to lock the body against pivotal movement in a predetermined rotational position about said second axis.

6. A vacuum cleaner as claimed in claim 5, in which said predetermined rotational position comprises a position in which a front face of body portion faces in the same direction as a front face of the head portion of the cleaner.

7. A vacuum cleaner as claimed in claim 5, in which the locking device is arranged to permit pivotal movement of the body about said second axis into said predetermined rotational position when the body is disposed in its most upright position.

8. A vacuum cleaner as claimed in claim 5, in which the actuator is biased into a position in which the body and neck portions are freely pivotable relative to each other when the body is pivoted away from its most upright position, the locking portion of the catch being arranged to engage in a circumferential groove disposed around the second axis when the body is pivoted into its most upright position.

9. A vacuum cleaner as claimed in claim 8, in which the circumferential groove is provided with a locking formation at a selected circumferential position, the locking portion engaging said formation when the body is at said predetermined rotational position.

10. A vacuum cleaner as claimed in claim 9, in which the locking portion is arranged to snap engage with said formation upon rotation of the body about said second axis.

11. A vacuum cleaner as claimed in claim 8, in which the lower end of the duct is received in the neck, the circumferential groove extending around the lower end of the duct inside the neck.

12. A vacuum cleaner as claimed in claim 1, in which the locking device is also arranged to prevent pivotal movement of the body about said first axis when the body is disposed in its most upright position.

13. A vacuum cleaner as claimed in claim 12, in which the locking device comprises a further catch for preventing said movement about the first axis.

* * * * *